United States Patent [19]

Hager et al.

[11] 4,157,686

[45] Jun. 12, 1979

[54] SEWING ASSEMBLY WITH A FEED DRIVE FOR A WORK HOLDER

[75] Inventors: Walter Hager, Kaiserslautern; Richard Müller, Mehlbach, both of Fed. Rep. of Germany

[73] Assignee: Pfaff Industriemaschinen GmbH, Fed. Rep. of Germany

[21] Appl. No.: 922,356

[22] Filed: Jul. 6, 1978

[30] Foreign Application Priority Data

Jul. 23, 1977 [DE] Fed. Rep. of Germany ..... 2733397
Apr. 26, 1978 [DE] Fed. Rep. of Germany ..... 2818179

[51] Int. Cl.[2] ..... D05B 21/00

[52] U.S. Cl. ..... 112/121.12; 112/303; 112/220

[58] Field of Search ..... 112/121.12, 121.11, 112/121.15, 203, 220, 118, 119, 86, 90

[56] References Cited

U.S. PATENT DOCUMENTS

| | | | |
|---|---|---|---|
| 3,358,626 | 12/1967 | Bryan | 112/121.12 |
| 3,543,737 | 12/1970 | Maschmann | 112/121.12 |
| 3,983,825 | 10/1976 | Dobner et al. | 112/121.12 |
| 4,088,085 | 5/1978 | Hager | 112/121.12 |

FOREIGN PATENT DOCUMENTS

| | | | |
|---|---|---|---|
| 290844 | 6/1965 | Netherlands | 112/121.15 |

*Primary Examiner*—Ronald Feldbaum
*Attorney, Agent, or Firm*—McGlew and Tuttle

[57] ABSTRACT

The invention relates to a feed drive for work holders of sewing assemblies, by which, during the formation of the initial stitches of a seam taking place at a low speed, the control cam plate moving the work holder is driven at a reduced speed, and, during the formation of the main part of the seam taking place at a high sewing speed, the control cam plate is driven intermittently in a manner such that at every lowermost position of the needle, the work holder is temporarily stopped. The feed drive comprises a planetary gearing having two inputs, of which the first input can receive a constant rotary motion, and the second input can receive, at the start of the seam formation, a continuous rotary motion which is subtractively superimposed upon the rotary motion at the first input, and, during the ordinary sewing operation, an oscillatory motion whose frequency is equal to the frequency of the needle bar motion.

10 Claims, 6 Drawing Figures

SEWING ASSEMBLY WITH A FEED DRIVE FOR A WORK HOLDER

FIELD AND BACKGROUND OF THE INVENTION

This invention relates in general to sewing machines and, in particular, to a new and useful sewing machine which includes a workpiece clamp which is engageable with the workpiece and is effective to move it through a feed path which is controlled in direction and amount by a planetary gear mechanism.

DESCRIPTION OF THE PRIOR ART

A drive system for the work clamp of a stitch group sewing machine is known from German Pat. No. 1,660,973, in which the cam plate controlling the feed motion of the work clamp is driven by a worm gear and the worm is put in axial oscillatory motions by a swash-plate gearing. The control cam plate is thereby sinusoidally accelerated or retarded in such a manner that, at every penetration of the needle into the work, the plate, and consequently, the work clamp, are temporarily stopped. This drive system is particularly unsuitable, however, for such sewing assemblies in which the work holder performs not only the feed motion during the sewing operation, but also movements between a feed station and the sewing operation, but also movements between a feed station and the sewing machine while the latter is stopped. That is, in such a case, it is very expensive to solve the problem of a drive connection between the work holder and the swash-plate-worm gear train and of coupling the work holder to a drive mechanism which is independent of the sewing machine, and then also of connecting the work holder to the swash-plate worm gearing in a manner true to phase.

A sewing unit has therefore been developed in which the sewing machine and the cam plate controlling the work holder are driven by separate motors. In this design, during a sewing cycle, the motor for the cam plate is switched on permanently, while the motor for the sewing machine is switched on and off by lobes provided on the cam plate. In order to obtain a large capacity of information storage, no standstill sections are provided between the control sections of the cam plate in this control cam plate, which is driven at a constant speed. In consequence, the work holder performs its feed motions even with the needle engaged in the work. The deflection resulting therefrom of the needle in the direction of the hook of the sewing machine may lead to troubles like needle fracture, thread rupture, faulty stitches, and increased wear of the hook. Since with the increasing sewing speed and stitch lengths, these troubles become more frequent and weightly, sewing speeds in excess of about 3,000 stitches per minute or stitches exceeding the length of 2.5 mm are no longer justifiable in such a sewing unit.

PROBLEM AND SOLUTION

To overcome the mentioned disadvantages, the invention is directed to a sewing assembly which makes it possible to move the work holder between a feed station and the sewing area at a standstill of the sewing machine and, during the formation of the seam, to drive the work holder in such a manner that in its lowermost position, the needle is not subjected to any lateral forces which would cause a deflection.

A sewing unit is known from German Pat. No. 735,507, in which a work holder performing only rotary motions can be accelerated or decelerated by means of planetary gearing in a manner such that the feed motions are interrupted by standstill periods. However, this discontinuous rotary motion of the work holder obtained by means of a control cam plate acting on the plantary gearing serves the sole purpose of determining, in cooperation with a sewing machine radially displaceable relative to the work holder, the run of the seams of a seam pattern.

The standstill periods of the work holder needed for forming radially extending seam portions must be compensated by an accelerated rotary motion of the work holder during the formation of other, not radially extending portions of the seam, so that the stitches produced are not uniform in length. The work holder is driven continuously, independently of the motion of the needle bar of the sewing machine, and, consequently, its feed motion continues even with the needle engaged in the workpiece, so that in this sewing unit again, troubles such as needle failures, thread ruptures, etc., are to be expected.

Since, with such a design, the planetary gearing is used solely to produce the shape of the seam and no possibility is provided to use the cam plate controlled planetary gearing for stopping the work holder exactly the instant the needle is in its lower dead center position, this prior art sewing unit could not contribute to the solution of the above problem.

Advantageously, the amplitude of the oscillatory drive motion produced by the swing drive mechanism and acting on the planetary gearing is so dimensioned that with the needle in its lower dead center position, the instantaneous velocity of the gear member absorbing the reaction torque is exactly equal to that produced by the continuous drive mechanism, so that due to the subtraction of these velocities, a momentary standstill of the work holder is obtained. Since the feed velocity of the work holder has already decreased prior to reaching the instant of standstill and does not increase to its maximum immediately thereafter, the needle undergoes only a negligibly small deflection during the period of its engagement in the workpiece, so that the sewing speed and the stitch length can be considerably increased while, at the same time, the incidence of trouble is reduced. Since the planetary gearing is capable of diring the work holder even in instances where only its input connected to the continuous drive mechanism receives motion while its input connected to the swing drive mechanism is standing idle, the work holder can, with the drive mechanism continuing to operate through an entire sewing cycle be driven either along with the sewing machine, upon simply switching the drive of the sewing machine on or off, in which case, it performs an intermittent feed motion due to the action of the swing drive mechanism synchronized with the drive of the sewing machine, or be driven independently of the sewing machine, in which case, it performs a uniform shifting motion.

Since the swing drive mechanism is synchronized with the drive of the sewing machine so that the oscillatory motion acting on the planetary gearing is continually in phase with the motion of the needle bar of the sewing machine, the drive of the sewing machine can be switched on at any instant of the cycle of motions of the work holder. For the same reason, the standstills of the work holder produced by the superimposition of the two drive motions taking place in the planetary gearing always coincide with the lower dead center position of the needle. Also, the sewing machine can be switched on during the shifting motion of the work holder, without having first to brake down the drive mechanism.

The inventive arrangement of a planetary gearing having two mechanical inputs is applicable, in principle, also to straight-seam sewing units in which the work is fed by means of conveyor belts. The single difference is that, in such a case, the output of the planetary gearing is operatively connected not to a control cam plate producing a seam of a certain configuration, but directly to the work holder embodied by the conveyor belts, so that in this case again, an intermittent feed motion is obtained.

Two embodiments of the invention covered by the dependent claims represent particularly advantageous modifications of the inventive design.

The feature that the arm shaft of the sewing machine is drive-connected to an eccentric and the eccentric rod embracing the eccentric is drive-connected to the planetary gearing, represents a particularly simple design of the swing drive mechanism operating in exact synchronism with the movements of the needle bar.

In sewing assemblies comprising a work holder which is driven by a control cam plate, quite generally, the initial stitches of a seam are sewn at a relatively low sewing speed, for example, of 200 stitches per minute, in order to obtain a secure and neat thread locking at the starting end of the seam. Only then does the sewing operation continue at a much higher, normal sewing speed, for example, of 3,000 stitches per minute. As far as the control cam plate in such sewing units is driven during the entire operation at a constant average speed, the accompanying necessity is that a disproportionately large angular sector of, for example, 20% of the cam plate portion provided for the seam formation, is associated with the slow initial stitches and only the remaining 80% are available for controlling the seam proper.

In a sewing unit known from U.S. Pat. No. 3,543,737, which comprises a work holder driven by a control cam plate having no standstill sectors, which would reduce the capacity of storing information, initially, with the sewing machine stopped, the control cam plate is driven by means of a first motor, in order to move the work holder from a feed station to the sewing area. Then, to produce the seam, the control cam plate is driven by means of a second motor which, at the same time, drives the sewing machine. While the initial stitches are formed, this motor runs at a low speed. Then, to produce the seam proper, the motor is switched to the normal, high speed. In this way, during both the formation of the initial stitches and during the formation of the seam proper, the control cam plate rotates at an operating speed corresponding to that of the sewing machine, so that the information path of the cam plate available for each stitch is uniform in length.

In this sewing machine unit of the prior art, however, just as in the unit discussed before, the control cam plate is driven continuously during the entire sewing operation, so that the work holder performs feed motions even with the needle engaged in the workpiece. In consequence, with the high speed at which the seam is formed, stitch and needle failures and an increased wear of the hook appear recurrently in the above-described manner.

This is why the invention is further directed to a sewing assembly comprising a control cam plate which is intermittently driven by means of a planetary gearing and a swing drive mechanism and serves the purpose of controlling a work holder, in which during the formation of the initial stitches taking place at a low speed, the control cam plate is also driven at a low speed.

To solve this problem, it is provided that the input associated with the swing drive mechanism of the planetary gearing can be selectively coupled to the latter or to a reduction drive-mechanism performing a rotary motion which is subtractively superimposed upon the rotary motion of the drive mechanism connected to the other input of the planetary gearing.

Due to the subtraction of two drive motions within the planetary gearing taking place with the reduction drive mechanism engaged, the control cam plate can be driven during the formation of the initial stitches at a relatively low speed, so that the few initial stitches are associated with a correspondingly small portion, for example, of 2% of the cam plate part provided for the seam formation. In this way, a relatively large portion of 98% is available for storing the path information of the seam proper, which makes it possible to either obtain more favorable gradients within the control curve or to provide a more extensive sewing program.

Since the frequency and intensity of the troubles, such as stitch or needle failure and greater wear of the hook, possibly occurring at a continuous drive of the control cam plate increase with the increasing sewing speed, a deflection of the needle and displacement of the needle thread loop from their normal positions do not become disturbingly noticeable at the relatively low sewing speed during the formation of the initial stitches. In any event, the possibility of disturbances, which is only theoretical at the low sewing speed, might be completely eliminated by providing standstill sections in that portion of the control curve which is associated with the initial stitches.

Upon producing the initial stitches, the reduction drive mechanism is put out of operation and instead, a drive connection is established between the swing drive mechanism and the planetary gearing, so that during the seam formation now taking place at the normal, high sewing speed, the control cam plate and, thereby, the work holder, are driven intermittently in the already described advantageous manner.

Due to a further provision that an additional drive mechanism is allowed to act on the control cam plate, the play of the gearing in the drive direction is eliminated, whereby, the control cam plate and the work holder are prevented from being set in uncontrolled vibrations during the intermittent drive.

Accordingly, it is an object of the invention to provide an improved sewing machine which includes means for engaging the workpiece and moving it through a path in respect to a sewing needle and which includes a separate drive for controlling the feed including a planetary gear mechanism with a swing member which is movable for adjusting the gears relative to each other so as to vary the speed of operation of a control cam which operates the linkage mechanism for positioning the workpiece.

A further object of the invention is to provide a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
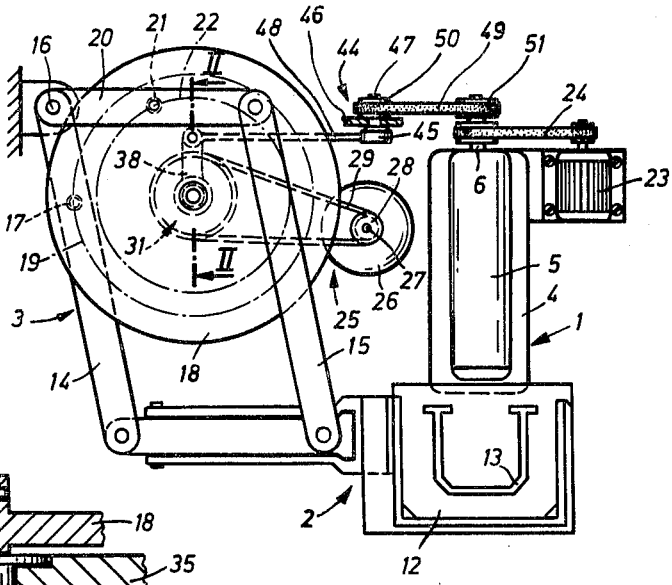
FIG. 1 is a top plan view of a sewing assembly comprising a feed drive mechanism and a planetary gearing constructed in accordance with the invention.

Referring to the drawings in particular, the invention embodied therein, comprises a sewing machine, generally designated 1, which has means in the form of a work clamp mechanism 2 for positioning a workpiece in respect to a needle 9 which is reciprocated at a sewing station to effect the sewing of a defined pattern which is outlined in the clamp. The sewing assembly shown in FIG. 1 comprises a sewing machine 1, a work holder, designed as a work clamp 2, and a guide mechanism 3 for the work clamp. FIG. 1 shows the lower housing 4 of the sewing machine 1 and the housing arm 5 and the main shaft 6, and FIG. 4 shows the housing head 7 only, the needle bar 8 and the needle 9 of the sewing machine 1.

Figure 4:
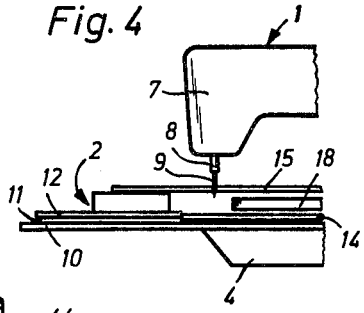
FIG. 4 is a front view of the front part of the sewing assembly.

The work clamp 2 which receives the workpiece, comprises a supporting plate 11 which is displaceable on a baseplate 4, shown in FIG. 4, and a clamping plate 12 is hinged thereto. As shown in FIG. 1, supporting plate 11 and clamping plate 12 are provided with a slot 13, the configuration of which corresponds to the seam to be produced and through which needle 9 can pass.

Work clamp 2 is connected to two links 14 and 15 of a parallelogram guide of guide mechanism 3, with link 14 being pivoted to a fixed pivot 16 and carrying a guide roller 17 which engages a curved groove 19 provided on the underside of control cam plate 18 and indicated in FIG. 1 as a dash-dotted circle to simplify the drawing. Link 15 is hinged to an intermediate member 20 which is also pivoted to pivot 16. Intermediate member 20 carries a guide roller 21 engaging a curved groove 22 which is provided on the top side of control cam plate 18 and also is shown as a dash-dotted circle in FIG. 1.

The drive of sewing machine 1 comprises a clutch motor 23 known per se with an auxiliary drive. Clutch motor 23 is connected to main shaft 6 by means of a drive belt 24. Control cam plate 18 is driven by a drive mechanism 25 comprising a motor 26, a pulley 28 secured to motor shaft 27 and a drive belt 29.

Drive belt 29 drives a casing 30 of a planetary gearing 31, which casing is designed as a pulley. Bearing flanges 32 and 33 are secured to the front sides of casing 30. Flange 32 is mounted on a hub 34. Hub 34 is firmly connected to a shaft 36 which is mounted on a mounting plate 35 of the sewing assembly and which carries the control cam plate 18 on its upper end. The other bearing flange 33 is mounted on a bushing 37 which is firmly connected to a control lever 38. The planetary gearing 31 comprises two inner sun wheels 39 and 40 of which sun wheel 39 is secured to hub 34 and sun wheel 40 is secured to bushing 37. Sun wheel 39 meshes with a planet pinion 41 and sun wheel 40 meshes with a planet pinion 42. The two planet pinions 41 and 42 are secured to a shaft 43 which is mounted in casing 30, so that casing 30 performs the function of a pinion cage. Due to the difference in the number of teeth of sun wheels 39 and 40 and planet pinions 41 and 42, a large reduction is obtained and planetary gearing 31 acts as a reduction gearing.

The hub 34, in planetary gearing 31, is connected to control cam plate 18 and forms the mechanical output A, and casing 30 which is connected to drive mechanism 25 forms a first mechanical input E1. A second mechanical input E2 is formed by bushing 37 or control lever 38 which is secured thereto. Second input E2 is connected to a swing drive mechanism 44.

Swing drive mechanism 44 comprises an eccentric 45, the eccentricity of which is adjustable in a manner known per se, and which is secured to a shaft 47 mounted on a cross-bar 46 of the frame (not shown) of the sewing assembly. Eccentric 45 is embraced by one end of an eccentric rod 48 whose other end is hinged to control lever 38. Eccentric 45 is driven by means of a cogged belt 49 which is associated with a pulley 50 on shaft 47 and a pulley 51 on main shaft 6.

Figure 3:
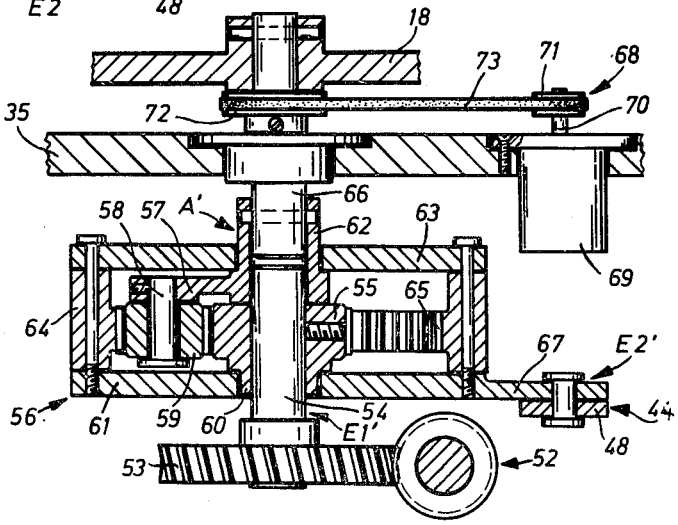
FIG. 3 is a sectional view, similar to FIG. 2, of another embodiment of the invention.

In the embodiment of FIG. 3, the drive mechanism 52 which drives control cam plate 18, comprises a motor (not shown) and a worm gear 53 which reduces the speed of the motor. The inner sun wheel 55 of a planetary gearing 56 is secured to shaft 54 driven by worm gear 53. A pinion gear 47 is also mounted for rotation on shaft 54, and it carries a planet pinion 59 which is mounted on a bearing bolt 58 and meshes with inner sun wheel 55. The housing of planetary gearing 56 is conjointly formed by a bearing flange 61 mounted on an extension 60 of inner sun wheel 55, a second bearing flange 63 mounted on a hub 62 of pinion cage 57, and a casing 64. On the inside of casing 64, an outer sun gear 65 is formed on which 59 engages. Hub 62 is firmly connected to a shaft 66 which, just as shaft 36 of the first embodiment, is mounted on mounting plate 35 and carries the control cam plate 18 on its upper end. Bearing flange 61 is formed with a control lever 67 which is hinged to eccentric rod 48 of swing drive mechanism 44 which latter is employed in unchanged design also for driving planetary gearing 56.

Hub 62 which is connected to control cam plate 18 forms the mechanical output A' in planetary gearing 56. Shaft 54, which is driven by worm gear 53, or feed drive mechanism 52, forms a first mechanical input E1', and control lever 67, provided on bearing flange 61, forms a second mechanical input E2'.

Figure 5:
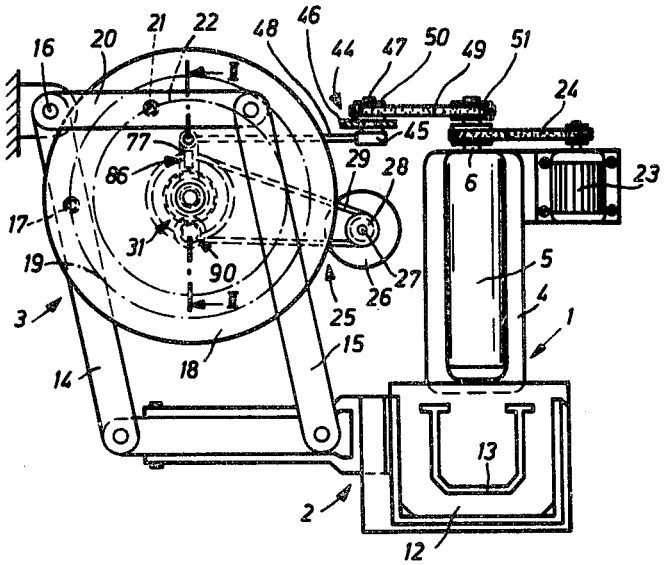
FIG. 5 is a top plan view of the sewing assembly in a third embodiment of the invention.
Figure 6:
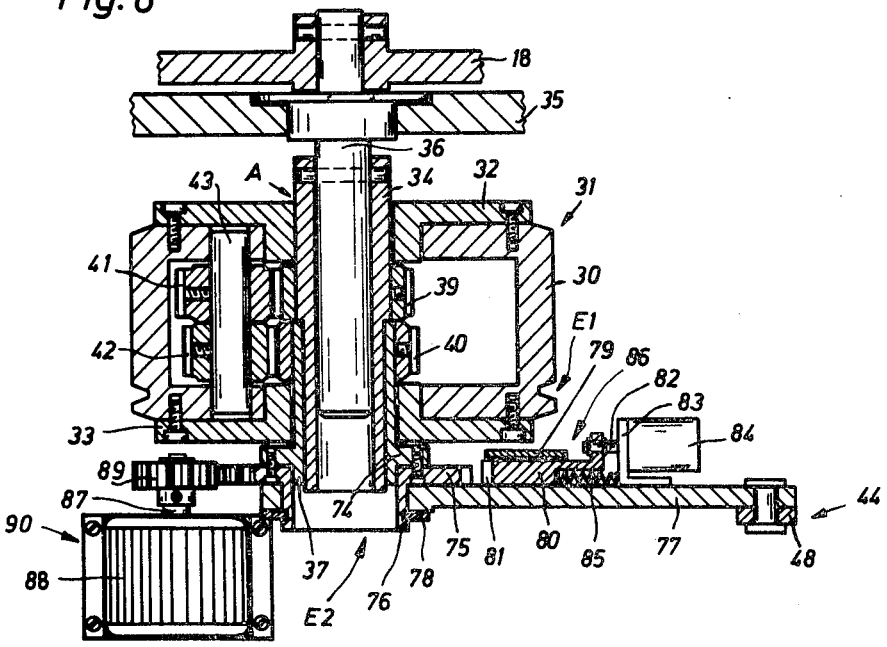
FIG. 6 is a sectional view of the planetary gearing of the sewing assembly and the reduction drive mechanism taken along the line VI—VI of FIG. 5.

FIG. 3 shows an alternate swing drive mechanism 68 comprising a rotating field magnet 69 carried by the mounting plate 35, a pulley 71 secured to the shaft 70 thereof, another pulley 72 secured to shaft 66, and a drive belt 73 connecting pulleys 71 and 72 to each other. This embodiment of the invention, shown in FIGS. 5 and 6, is largely identical with the embodiment of the invention shown in FIGS. 1 and 2. A flange 74 is formed on bushing 37 in the planetary gearing 31 of this third embodiment. A gear 75 which is provided with a hub 76 is secured to flange 74. The swing drive mechanism 44' of the third embodiment is provided with a control lever 77, instead of control lever 38, with one end being mounted for free rotation on hub 76 of gear 75 and held axially in position by means of a guard ring 78.

On the side closest to gear 76 of the control lever 77, a sliding bar 80 is mounted by means of a guide 79 for radial displacement in the direction of gear 75, and the end of the bar facing gear 75 is designed as a tooth-shaped engaging portion 81. The other end of sliding bar 80 is connected to the tie rod or plunger 82 of an electromagnet 84 which is secured to an angle plate 83. With the electromagnet 84 deenergized, a compression spring 85 presses bar 80 against gear 75, thereby, holding engaging portion 81 in operative engagement with the teeth of gear 75. Together, sliding bar 80 and electromagnet 84 form a clutch 86 between input E2 and swing drive mechanism 44.

The shaft 87 of a braking motor 88 carries a pinion 89 permanently meshing with gear 75. In the switched-off state, and with the brake disengaged, motor 88 can be rotated freely, so that it does not hinder the drive motion produced by swing drive mechanism 44. Braking motor 88 forms a reduction drive mechanism 90 along with pinion 89.

OPERATION

Figure 2:
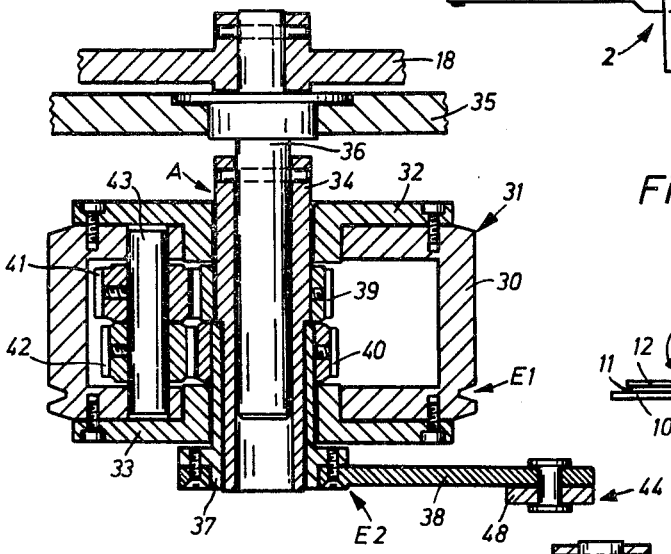
FIG. 2 is a sectional view of the planetary gearing taken along the line II—II of FIG. 1.

In the first embodiment of the invention, shown in FIGS. 1, 2 and 4, after placing the workpiece to be processed in a work clamp 2 of a feed station spaced from the sewing machine 1, the motor 26 of the drive mechanism 25 is switched on for the entire duration of a sewing cycle. With motor 26 switched on, belt 29 drives casing 30 of planetary gearing 31, so that mechanical input E1 is driven at a uniform motion. During this period of time, clutch motor 23 of sewing machine 1 is still switched off, so that swing drive mechanism 44 and control lever 38 stand still. Due to the rotary motion of casing 30, pinion 42 rolls on sun wheel 40 which stands still, since mechanical input E2 does not receive motion, and absorbs the reaction torque produced by the rolling motion of pinion 42. Due to the rolling motion of pinion 42, shaft 43 is driven and its rotation is transmitted through pinion 41 to sun wheel 39 and, thereby, to hub 34. With control lever 38 at rest, the uniform drive motion at input E1 results in an also uniform drive motion at output A, wherefore, control cam plate 18 performs a continuous rotary motion.

The rotary motion of control cam plate 18 produces a pivotal motion of the two links 14 and 15, as a function of the shape of curved grooves 19 and 22, whereby, a motion composed of two components is imparted to work clamp 2 and the clamp is transferred from the feed station to the sewing area of sewing machine 1.

As soon as work clamp 2 has reached the sewing area, first the auxiliary drive of clutch motor 23 is switched on by means of a cam (not shown) of control cam plate 18, so that sewing machine 1 is driven at a low speed. After the initial stitches have been produced, the auxiliary drive of clutch motor 23 is switched off by means of a cam (not shown) of control cam plate 18, and clutch motor 23 is switched on, so that, from that instant, the sewing operation is continued at a high sewing speed. During the sewing operation, control cam plate 18 imparts a feed motion corresponding to the shaft of the seam pattern to be produced to work clamp 2, through links 14 and 15.

With the sewing machine 1 running, main shaft 6 drives eccentric 45 through cogged belt 49, and eccentric 45 imparts an oscillatory motion to control lever 38 through eccentric rod 48 and, thereby, to sun wheel 40. This oscillatory drive motion, produced by swing drive mechanism 44 and introduced into planetary gearing 31 through input E2, is superimposed by the continuous drive motion which is produced by drive mechanism 25 and introduced into planetary gearing 31 through input E1. The phase position of eccentric 45 is adjusted to the motion of needle bar 8 in such a manner that, with needle 9 engaged in the workpiece, the swing direction of sun wheel 40 coincides with the direction of rotation of casing 30, whereby, the drive motion of sun wheel 40 is subtracted from the drive motion produced by drive mechanism 25. On the contrary, with needle 9 in a position above the workpiece, the swing direction of sun wheel 40 and the direction of rotation of casing 30 are in opposition, so that the two drive motions are added to each other. Due to the superimposition of the drive motions introduced into planetary gearing 31 through the two inputs E1 and E2, a sinusoidally accelerated and decelerated drive motion is produced at output A.

The eccentricity of eccentric 45 is adjusted in a manner such that, with needle 9 is its lower dead center position, the drive motion introduced into planetary gearing 31 through input E2 and the drive motion introduced through input E1 have exactly the same speed. Thus, due to the subtraction of the motions, a short standstill of hub 34 and, thereby, of control cam plate 18 and work clamp 2 is obtained as needle 9 occupies its lowermost position. Since the feed motion of work clamp 2 is reduced by the subtraction of the drive motions prior to reaching the standstill of work clamp 2, and does not reach its maximum immediately after the standstill, needle 9 experiences only a negligible deflection during its dwell in the workpiece, so that with a simultaneously reduced trouble incidence, the sewing speed and the stitch length can be considerably increased.

In the embodiment of FIG. 3, with the sewing machine 1 stopped and drive mechanism 52 switched on, worm gear 53 drives inner sun wheel 55 through input E1' at a uniform speed. Due to the rotation of inner sun wheel 55, pinion 59 rolls on outer sun gear 65 which, with swing drive mechanism 44 at rest, also stands still and absorbs the reaction torque produced by the rolling motion of pinion 59. The rolling motion of pinion 59 drives pinion cage 57 and, thereby, shaft 66 carrying control cam plate 18. With control lever 67 at rest, the uniform drive motion at input E1' results in an also uniform drive motion at output A', so that control cam plate 18 executes a continuous rotary movement to drive work clamp 2.

With the sewing machine 1 switched on, eccentric 45 of swing drive mechanism 44 imparts an oscillatory motion to control lever 67 and, thereby, to outer sun gear 65. In the first embodiment of the invention, this oscillatory motion is superimposed by the continuous drive motion produced by drive mechanism 52. At the same time, swing drive mechanism 44 is adjusted to the motion of needle bar 8 in a manner such that, with needle 9 engaged in the workpiece, the swing direction of outer sun gear 65 is opposite to the direction of rotation of pinion cage 57, whereby, the drive motion of outer sun gear 64 is subtracted from the drive motion produced by drive mechanism 52. With needle 9 in a position above the workpiece, on the contrary, the swing direction of outer sun gear 65 coincides with the direction of rotation of pinion cage 57, so that in such an instance, the two drive motions are added to each other. Because of the superimposition of the drive motions introduced into planetary gearing 56 through the two inputs E1' and E2', a sinusoidally decelerated and accelerated drive motion is produced at output A' in the same manner as in planetary gearing 31. By a suitable adjustment of the eccentricity of eccentric 45, a short standstill of control cam plate 18 and, thereby, of work clamp 2 can be obtained at the instant at which needle 9 is in its lowermost position.

The additional drive mechanism 68, shown in FIG. 3, produces a torque which is imparted to the shaft 66 carrying control cam plate 18 and acts in the direction of rotation thereof, in addition to the drive torque proper produced by planetary gearing 56, so that the play of the gearing in the direction of rotation is eliminated. In this way, the control cam plate 18 and work clamp 2 are prevented from being set in uncontrolled vibrations by the intermittent drive. Since additional drive mechanism 68 must not influence the drive motion of control cam plate 18, the speed of the drive motor of additional drive mechanism 68 is to be made automatically adjustable to the respective speed of shaft 66. Aside from the rotating field magnet 69, an air motor for example would also be suitable for this purpose.

The additional drive mechanism 68, shown in connection with the second embodiment may be employed equally well with the first embodiment, so that uncontrolled vibrations of control cam plate 18 and work clamp 2 can also be eliminated.

In the third embodiment of the invention, shown in FIGS. 5 and 6, after placing the workpiece to be processed into work clamp 2, which is at a location spaced from the sewing machine 1, motor 26 of drive mechanism 25 is switched on in the same manner as in the first embodiment of the invention for the entire duration of a sewing cycle. Simultaneously with motor 26, electromagnet 84 is energized by which sliding bar 80 is disengaged from gear 75 and rectracted into an ineffective position spaced therefrom.

With motor 26 switched on, belt 29 drives casing 30 of planetary gearing 31, whereby, a uniform drive motion is imparted to input E1. During this period of time, clutch motor 23 of sewing machine 1 is still disengaged, so that swing drive mechanism 44 and control lever 77 stand still. Brake motor 88 is also switched off during this period of its brake is applied, so that gear 75 is at rest.

As already described in connection with the first embodiment of the invention, if a continuous drive motion is imparted to input E1 and input E2 stands still, a uniform drive motion is obtained at output A, resulting in a continuous rotary motion of control cam plate 18. Due to the rotary motion of control cam plate 18, work clamp 2 is moved from the feed station to the sewing area of sewing machine 1.

Shortly before work clamp 2 reaches the sewing area, first, the brake of brake motor 88 is released and then brake motor 88 is switched on, by means of a first lobe (not shown) provided on control camp plate 18. Brake motor 88 now imparts a rotary motion to gear 75, which motion has the same direction as the rotary motion of casing 30, whereby, the drive motion of input E2 is subtracted from the drive motion of input E1. The drive motion at output A and, thereby, the rotary motion of control cam plate 18 are then consequently slower then during the time in which the reduction drive mechanism 90 is ineffective.

As soon as work clamp 2 has reached the sewing area, the auxiliary drive of clutch motor 23 is switched on by means of a second lobe (not shown) of control cam plate 18, so that swing machine 1 is driven at a low speed. Thereupon, with brake motor 88 switched on as before and, consequently, with control cam plate 18 running at a relatively low speed, the initial stitches, for example, three stitches, of the seam are produced at a low sewing speed. With sewing machine 1 running, main shaft 6 drives eccentric 45 through cogged belt 49, and the eccentric imparts an oscillatory motion to control lever 77 through eccentric rod 48. During the formation of the initial stitches, electromagnet 84 remains energized, so that sliding bar 80 is still in its retracted, ineffective position. Consequently, during this period of seam formation, control lever 77 executes a relative motion in respect to gear 75 which is driven by brake motor 88.

After termination of the initial stitches, brake motor 88 is switched off, for example, by means of a third lobe (not shown) of control cam plate 18, the brake of the motor, however, remains released, so that the motor can turn freely. Simultaneously, electromagnet 84 is deenergized, whereupon, compression spring 85 displaces sliding bar 80 in the direction of gear 75. As soon as engaging portion 81 snaps between two teeth of gear 75, clutch 86 is engaged and a driving connection is established between swing drive mechanism 44 and geat 75 or input E2. Simultaneously, with brake motor 88 and electromagnet 84, the auxiliary drive of clutch motor 23 is also switched off and clutch motor 23 is switched on and as from this instant, the sewing operation continues at a high sewing speed.

During the sewing operation at high speed, planetary gearing 31 and swing drive mechanism 44 operate in the same manner as in the first embodiment of the invention. Therefore, in this embodiment again, control cam plate 18 executes such a sinusoidally decelerated and accelerated motion that, with the needle 9 in its lower dead center position, work clamp 2 is temporarily stopped. Since this causes only a negligibly small deflection of needle 9 during the sewing operation at high speed, difficulties, such as stitch or needle failures or increased wear of the hook do not occur with the third embodiment of the invention either.

With the sewing operation terminated, clutch motor 23 is switched off, whereby, sewing machine 1 and swing drive mechanism 44 are stopped. Further, the brake of brake motor 88 is applied, so that gear 75 stands still. The sole still running motor 26 imparts a uniform rotary motion of ordinary speed to control cam plate 18, whereby, work clamp 2 is moved back into the feed station spaced from sewing machine 1. Upon reaching the feed station, motor 26 is also switched off and the processed workpiece can be removed from the stopped work clamp 2.

While specific embodiments of the invention have been shown and described in detail to illustrate the application of the principles of the invention, it will be understood that the invention may be embodied otherwise without departing from such principles.

What is claimed is:

1. A sewing machine for sewing a pattern on a workpiece, comprising a housing, a rotatable main shaft rotatably mounted in said housing, a needle mounted on said housing for reciprocating movement and connected to said main shaft for movement thereby, first drive means connected to said main shaft to rotate said main shaft and move said needle, a rotatable control cam, a workpiece clamp engageable with the workpiece to advance it into association with the needle, an operating mechanism connected to said workpiece clamp having at least one follower engageable with said control cam and movable thereby, a cam drive motor, a rotatable drive pulley connected to said cam drive motor for rotation thereby, a cam drive shaft connected to said control cam, a planetary gear mechanism associated with said drive pulley including rotatable sun and planet gears connected between said drive shaft and said drive pulley, and a swing member connected to said planetary gear mechanism to shift said sun and planet gears relatively, and means connected between said main shaft and said swing member to drive said swing member from said main shaft.

2. A sewing machine, as claimed in claim 1, wherein said planetary gear mechanism includes an output connected to said workpiece clamp and first and second inputs, said first input being connected to said cam drive motor, said second input being connected to said swing member, said planetary gear mechanism including a sun gear member absorbing the reaction torque produced by said cam drive motor and at least one planetary gear engageable with said sun gear driven in dependence on the drive of the sewing machine and in a manner such that with the needle engaged in the workpiece, a subtraction of the drive motion takes place, the subtraction reaching its maximum substantially as the needle is in its lower dead center position.

3. A sewing machine, as claimed in claim 2, wherein said control cam comprises a cam plate, said planetary gear mechanism having an output connected to said control cam plate.

4. A sewing machine, as claimed in claim 3, wherein said planetary gear mechanism inludes first and second sun gears and first and second planetary gears engageable with respective first and second sun gears, one of said sun gears being connected to said cam plate, the other of said sun gears being connected to said swing member.

5. A sewing machine, as claimed in claim 1, wherein said planetary gear mechanism comprises an inner sun wheel, a planet cage, a planet pinion rotatably supported on said cage around said sun wheel, an outer sun wheel connected to said housing and engaged with said planet gear, said inner sun wheel being connected to said main shaft for rotation thereby, said outer sun wheel being connected to said swing member.

6. A sewing machine, as claimed in claim 1, wherein said swing member includes an eccentric connected to said main shaft to rotate said eccentric to cause oscillation of said swing member, a rod connected to said swing member and to said planetary gearing.

7. A sewing machine, as claimed in claim 2, wherein the input of said planetary gearing can be selectively coupled to said swing member and including a reduction drive providing a continuous rotary motion selectively connectable to said planetary gearing input.

8. A sewing machine, as claimed in claim 7, wherein said reduction drive comprises a motor having a motor shaft, a pinion secured to said motor shaft connected to the input of said planetary gearing and a clutch connected between said swing member and said gear.

9. A sewing machine, as claimed in claim 8, wherein said swing drive mechanism has an eccentric rod hinged at one end to a control lever and has an opposite end coaxially mounted for free rotation on said gear, said clutch comprising a sliding bar supported by and movable on said control lever and having one end with at least one tooth-like projection engageable with said gear and having an opposite end connected to an electromagnet plunger.

10. A sewing machine, as claimed in claim 1, including an additional drive mechanism connected to said cam plate for driving said cam plate in the direction of rotation, and means for adjusting the speed of said additional drive member in accordance with the speed of the planetary gearing.

* * * * *